US005228929A

United States Patent [19]

Panasiuk et al.

[11] Patent Number: 5,228,929

[45] Date of Patent: Jul. 20, 1993

[54] THERMOCHEMICAL TREATMENT OF MACHINERY COMPONENTS FOR IMPROVED CORROSION RESISTANCE

[76] Inventors: Wladyslaw Panasiuk, ul. Marymoncka 39/3, Warsaw 01 868, Poland; Michel Korwin, 557 Therrien, Montreal, Quebec, Canada, H4C 3N5

[21] Appl. No.: 697,019

[22] Filed: May 8, 1991

[30] Foreign Application Priority Data

May 15, 1990 [CA] Canada ..... 2016843

[51] Int. Cl.[5] ..... C23C 8/22

[52] U.S. Cl. ..... 148/232; 148/220

[58] Field of Search ..... 148/217, 220, 232, 235

[56] References Cited

U.S. PATENT DOCUMENTS 4,391,654 5/1983 Wyszkowski et al. .
4,496,401 1/1985 Dawes et al. .
4,596,611 6/1986 Dawes et al. .
4,710,238 12/1987 Dawes et al. .
4,713,122 12/1987 Dawes et al. .

FOREIGN PATENT DOCUMENTS 0061272 9/1982 European Pat. Off. .
0299625 1/1989 European Pat. Off. .
2138028 10/1984 United Kingdom ..... 148/217
2170825 8/1986 United Kingdom .
2234266 1/1991 United Kingdom .
87/05335 9/1987 World Int. Prop. O. .

OTHER PUBLICATIONS

Patent Abstracts of Japan, vol. 14, No. 80 (C-689)(4023) Feb. 15, 1990 & JPA-1298146 Dec. 1989.
Patent Abstracts of Japan vol. 10, No. 23 (C-325)(2080) Jan. 1986 & JP-A-60-177174 Sep. 1986.
Patent Abstracts of Japan, vol. 7, No. 269 (M-14)(269) Nov. 30, 1983 JP-58-146 762 Sep. 1, 1983 Abstract.

*Primary Examiner*—John P. Sheehan
*Attorney, Agent, or Firm*—ROBIC

[57] ABSTRACT

Disclosed is a process for manufacturing a corrosion resistant iron-alloy, powered metal or sintered carbide component. In a first step, the component is subjected to an initial thermochemical treatment preferably consisting of nitriding, in a closed furnace in order to form onto the surface of the component a nitrogen diffusion zone followed by the superficial layer consisting of $\gamma'$ and $\epsilon$ nitride layers. In a second step, an aqueous solution comprising oxygen, carbon, nitrogen and sulfur is introduced into the furnace for a period of time sufficient to allow transformation of the $\epsilon$ nitride layer into a porous layer of ferrous oxide(s). This process is particularly efficient and permits to produce a superficial porous ferrous oxide layer thicker than 2 $\mu$m onto a nitride steel component.

11 Claims, 4 Drawing Sheets

1. NO TREATMENT
2. HARD CHROME 12 μM THICKNESS
3. ELECTROLESS NICKEL 20 μM THICKNESS
4. Q.P.Q. TREATED (REGISTERED TRADE MARK KOLENE CORP.)
5. NITROTEC
6. NILTREG ONC TREATED AT 530°C (986°F) FOR 1 HOUR

THE CORROSION RESISTANCE IS DEFINED HERE AS THE TIME NECESSARY TO PRODUCE THE FIRST CORROSION SPOT ON THE SPECIMEN SURFACE.

CORROSION RESISTANCE OF 1045 STEEL TREATED WITH NITREG ONC PROCESS AT VARIOUS TEMPERATURES.

THERMOCHEMICAL TREATMENT OF MACHINERY COMPONENTS FOR IMPROVED CORROSION RESISTANCE

BACKGROUND OF THE INVENTION

1. Field of the invention

This invention relates to improvements in thermochemical treatment of steel components designed to produce on the surface of the components a layer capable of withstanding corrosion attack for an extended period of time.

2. Brief description of the prior art

In the prior art, various oxidizing treatments are known and commonly used to produce on the surface of previously nitrided or nitro-carburized components, a thin layer of oxides predominantly made-up of $Fe_3O_4$, usually less than 1 micron in thickness. This objective is obtained either by immersing the previously hardened (nitrided) components in toxic oxidizing salts or by exposing these components to a controlled oxidizing atmosphere. These known methods are efficient but have serious drawbacks. Indeed, when the hardening and oxidizing treatment is carried out in salts, it usually involves first hardening in potassium cyanide/cyanate bath, followed by water quenching and subsequent polishing and reoxidizing in a separate bath. Salt bath treatment poses serious environmental and health problems and involves multiple processing stages, rather awkward in serial production. Moreover, it does not offer an adequate corrosion protection.

In other development as described in U.S. Pat. No. 4,496,401, the steel components are hardened by a ferritic nitrocarburizing process and subsequently subjected to an oxidizing atmosphere for a limited period of time. The oxidation takes place usually in the air and is followed by a rapid quench This treatment allows the formation of a nitrogen diffusion zone followed by a layer of $\epsilon$ iron nitride or carbonitride and by another oxide-rich superficial layer impregnated of oil or wax, on the surfaces of the steel components Other variation of this process involves polishing and reoxidizing at different temperature followed possibly by a quench.

It is felt that processing of components in such a manner has also some major disadvantages, namely high processing temperatures, thick and relatively brittle superficial layer as well as uncontrolled oxidizing conditions in the free air.

U.S. Pat. No. 4,391,654 describes a process especially designed for high speed cutting tools, which basically consists in subjecting the steel component to a preliminary oxidation before subjecting it to hardening, which allows the formation of a nitrogen diffusion zone onto the surface of the steel component while eliminating the simultaneous formation of superficial $\epsilon$ or $\gamma'$ iron nitride or carbonitride layers.

OBJECTS OF THE INVENTION

A first object of the present invention is to produce steel components having increased corrosion resistance.

Another object of the invention is to transform at least the superficial $\epsilon$ nitride of a nitrided superficial layer into a porous ferrous oxide layer.

A further object of the invention is to produce a superficial porous ferrous oxide layer thicker than 2 $\mu$m onto a nitrided component.

Still another object of the invention is to produce a superficial porous ferrous oxide layer without having to immerse the component into toxic oxidizing salts.

Still a further object of the invention is to produce steel components having increased mechanical properties (adherence, hardness).

SUMMARY OF THE INVENTION

The invention provides a process for manufacturing a corrosion resistant, iron-alloy, ion powder metal or ion alloy powder metal component in a closed furnace, which process comprises the steps of:

a) subjecting the component to an initial thermochemical nitriding treatment in the furnace in order to form onto the surface of the component a nitrogen diffusion zone followed by a superficial composite layer consisting of $\gamma'$ and $\epsilon$ nitride layers;

b) subsequently introducing into the furnace an aqueous solution hereinafter called ONC solution, comprising oxygen, carbon, nitrogen and sulfur for a length of time sufficient to allow transformation of most of the external $\epsilon$ nitride layer into a porous layer of ferrous oxide(s) having a thickness of about 2 to 10 $\mu$m;

c) removing from the furnace any excess of the vapor formed ONC solution or vapor formed therefrom; and d) allowing the component to cool down inside said furnace.

According to a first preferred embodiment of the present invention, the initial thermochemical treatment comprises nitriding exclusively.

According to a second preferred embodiment of the present invention, the initial thermochemical treatment comprises water vapor oxidation followed by nitriding.

The invention also provides a corrosion resistant iron-alloy-, iron powder metal-, or iron powder alloy component having an external surface comprising:

(a) a nitrogen diffusion zone, followed by (b) a $\gamma$40 0 iron nitride or carbonitride layer; and by (c) a porous oxide rich superficial layer consisting mainly of $Fe_3O_4$ and having a thickness of about 2 to 10 $\mu$m on the $\gamma'$ nitride layer.

DETAILED DESCRIPTION OF THE INVENTION

The process according to the invention involves an initial thermochemical treatment whose purpose is to harden the surface of component to be treated, and a subsequent oxidizing treatment carried out with the ONC solution. In accordance with the invention, the entire process including the hardening and oxidizing steps, is carried out in one closed, forced-circulation vessel or furnace. The oxidizing step carried out with the ONC solution follows the hardening step and is carried out at temperatures that may be higher than those of the hardening treatment.

The hardening treatment preferably consists of a nitriding treatment which may be carried out in ammonia containing atmosphere in the absence of endothermic or exothermic gases.

The process according to the invention is thus based on the already known nitriding technology supplemented by a new complex saturation of the superficial layer that is obtained, with carbon, nitrogen, oxygen and sulphur (ONC). The process can be applied to all types of steel.

Figure 1:
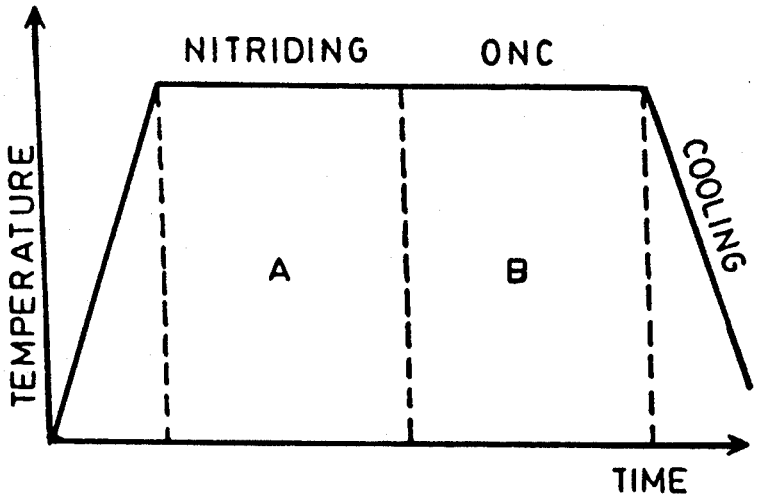
FIG. 1 represents a graph of the temperature versus the time of reaction for the different stages in the process according to the first embodiment of the present invention.
Figure 2:
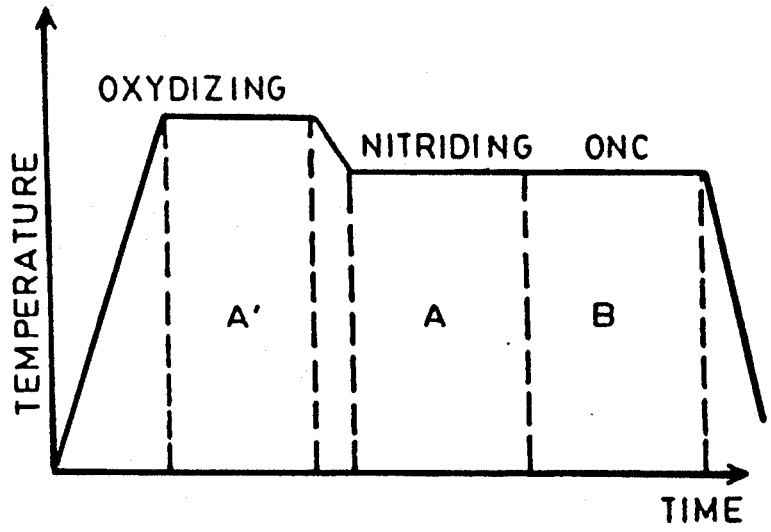
FIG. 2 represents a graph of the temperature versus the time of reaction for the different stages in the process according to the second embodiment of the present invention.

The process according to the invention typically comprises two major steps as is shown in FIG. 1. A variation of the process is designed for high speed cutting tools. In this variant, the process comprises three steps as is shown in FIG. 2.

Steps A and A' are known from the prior art.

The oxidizing step (A') used in the variant of the invention, is disclosed in U.S. Pat. No. 4,391,654 and usually carried out at a temperature of about 350° to 650° C. within a time framework of 5 to 120 min.

The nitriding step (A) is usually carried out at temperatures of about 400° to 700° C. for periods of time of about 5 min. to 50 hours.

When the nitriding step is used alone as is shown in FIG. 1, i.e. without preliminary oxidation step A' as shown in FIG. 2, a nitrogen diffusion zone followed by a non-porous, compact multiphase compound superficial layer (epsilon and gamma prime nitride mixture) approximately 10 to 20 microns in thickness, are formed on the surface of the steel component. In specific situations where corrosion resistance is the only requirement, the superficial layer may be thicker.

The ONC treatment used in the present invention causes the "external" portion of this superficial layer to be transformed into a porous oxide-rich layer consisting mainly of $Fe_3O_4$. The portion that is so transformed, is not exclusively the superficial $\epsilon$-nitride phase. As a matter of fact, a portion of the $\gamma'$-nitride layer may also be modified by the treatment.

Once the nitriding step is completed, the ONC treatment begins immediately thereafter. It consists basically of injecting an aqueous ONC solution of one or more organic or inorganic, soluble compounds that are selected to provide either individually or collectively oxygen, carbon, nitrogen and sulfur. This injection is carried out for a given period of time, typically 1 hour, into the same closed furnace or vessel where the nitriding step was carried out previously.

A typical injection rate is 2 to 3 liters per minute of ONC solution and may be adjusted according to the charge size.

The aqueous ONC solution advantageously contains from 0.7 to 7.7% nitrogen, 4.2 to 46.2% carbon, 1.6 to 17.6% sulfur, and 2.2 to 24.2% oxygen and is preferably acidic, with a pH lower than or equal to 4. By way of example, a suitable ONC solution can be made by dissolving into water at least one compound of the saccharin family, selected from the group consisting of:

saccharin, alkali salts of saccharin, cyclamic acid, sodium cyclamate, sodium-3-methylcyclohexylsulfamate, sodium-3-methylcyclopentylsulfamate, 4-nitrosaccharin, 6-aminosaccharin, o-benzenesulfimide, 5-methylsaccharin, 6-nitrosaccharin, and thieno [3,4d] saccharin.

Typically, the ONC treatment is carried out at a temperature ranging from 520° C. to 540° C. for about 5 min. to 4 hrs.

After completion the ONC treatment, the vessel is cooled down with water vapor, acidic water vapor, an inert gas or $NH_3$-saturated vapor to displace the water vapor formed in the vessel by the ONC solution and the treated components are taken out from the furnace, at approximately 200° C. and cooled down in the open air down to 60° C.

The acidic water vapor used to displace the water vapor generated by the ONC solution is previously adjusted to a pH lower than or equal to 4.

Figure 3:
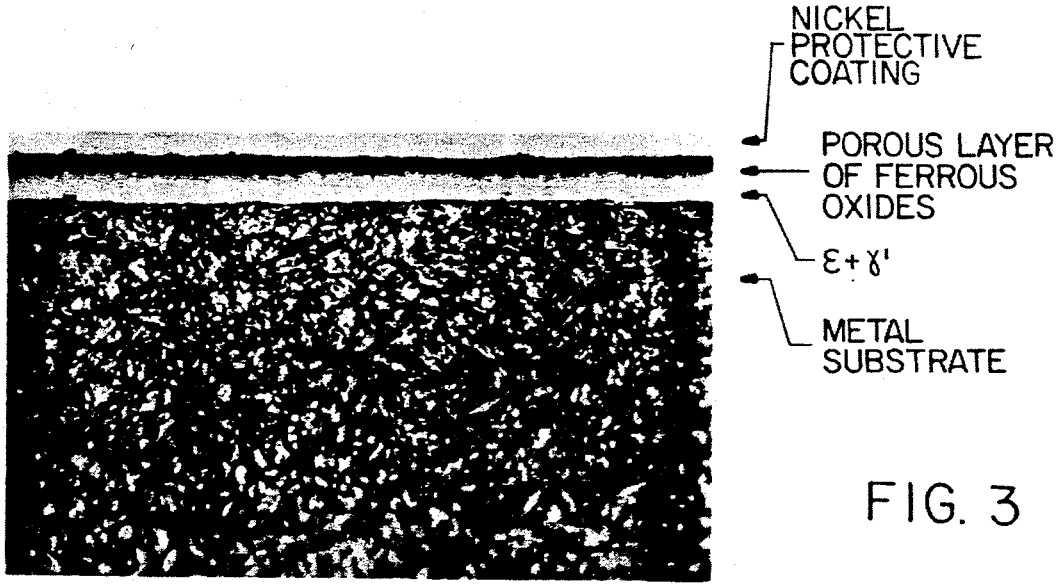
FIG. 3 represents a cross section of the outer portion of a piece of steel treated with the process according to the first embodiment of the invention, (magnification 500×)

As a result of such a treatment, the white layer present on the component surface is modified. It consists of two adhering layers, i.e. an outer layer consisting mostly of $Fe_3O_4$ intermetallic spinels and an inner layer consisting of $\gamma'$ nitride. The $\epsilon$ phase layer is thus mostly transformed during treatment and is no longer present in the microstructure. Under some circumstances, a portion of the $\gamma'$, layer generated by the nitriding treatment may also be transformed. A typical example of such a microstructure is shown in FIG. 3.

Depending on the temperature of the treatment, the modified layer consist essentially of a mixture of $Fe_3O_4$, $Fe_2O_3$, FeO, $Fe_3C$ or any combination thereof. Moreover, this layer also usually contains 0.2% S.

Components produced with the treatment usually have a thin, typically 2–10 $\mu$m superficial layer of oxides saturated carbon, oxygen and sulfur.

Figure 4:
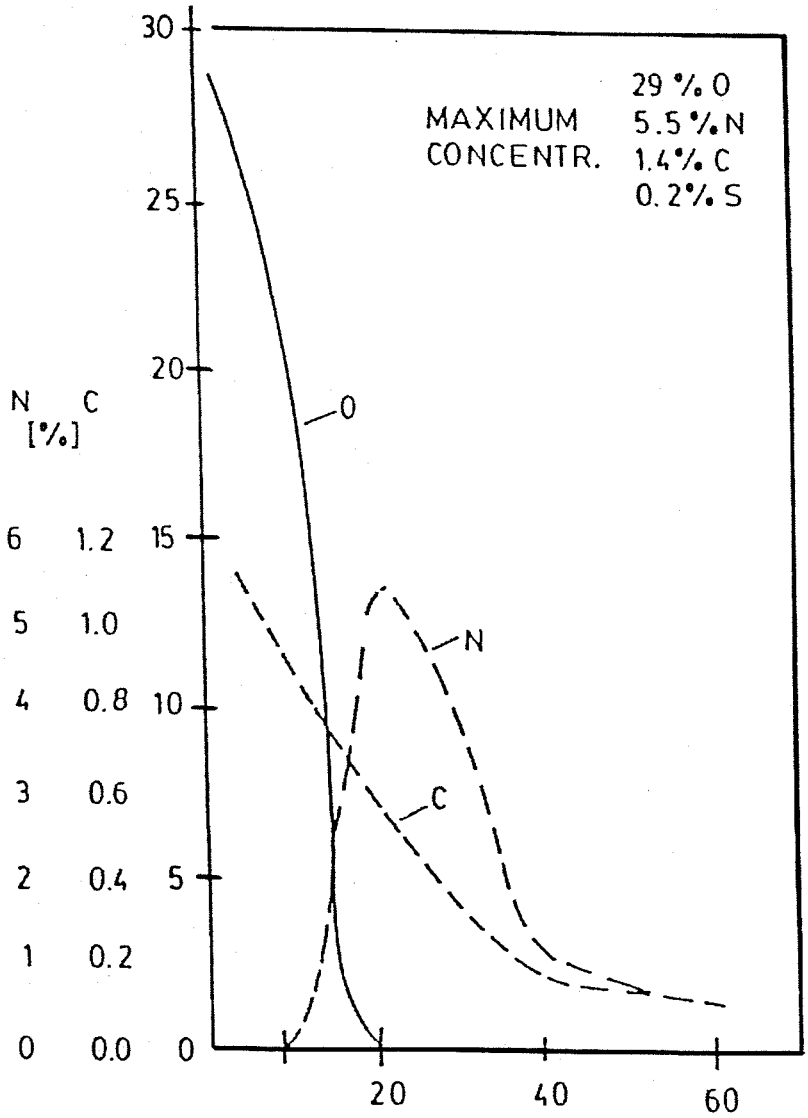
FIG. 4 represents the concentration profile in the superficial layer on low alloy steel treated at 530° C. according to the invention.

The chemical composition of the superficial layer, its structure thickness and properties strongly depend on the temperature of the process. An increase in the processing temperature results in a gradual saturation with oxygen and carbon, with the sulphur concentration remaining insensitive to the temperature changes. An increased temperature also induces the formation of other ferrous oxides, such as $Fe_2O_3$ and possibly cementite. A typical concentration profile on low alloy steel is shown in FIG. 4.

In other words, the higher is the temperature and/or the longer is the duration of the ONC treatment, the thicker is the superficial oxide-rich layer and thus the higher is the corrosion resistance.

The superficial hardness of medium carbon steel, for example, can go up to 550HVl and falls as the temperature of the treatment increases. The corrosion resistance in turn depends on the treatment temperature. The best corrosion protection is offered by the highest temperature treatments.

The superficial oxide layer formed on the existing nitride substructure is porous in nature. Typically, the oxide-rich layer comprises pores having a size ranging from about 0.5 to 5.0 μm. The size of the pores depends on the process temperature as well as the length of the process.

Figure 5:
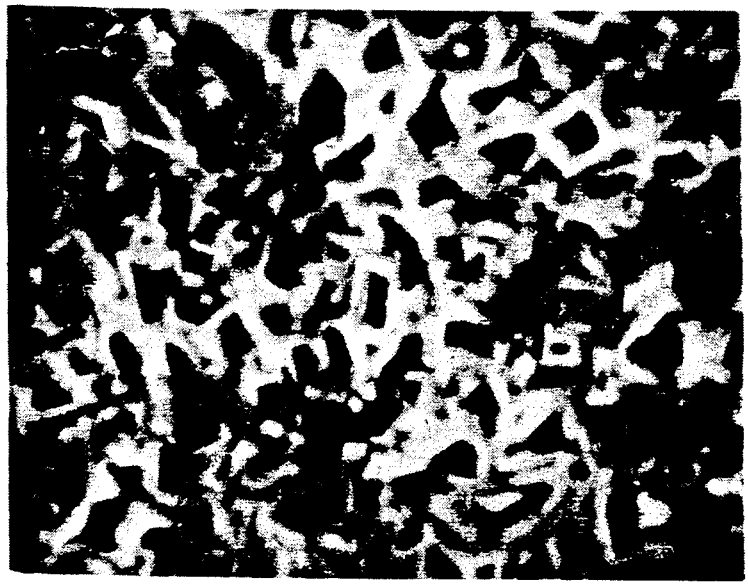
FIG. 5 represents the superficial appearance of the steel presented on FIG. 3 treated with the process at 530° C. (magnification 3000×)

The increase in corrosion resistance is directly proportional to the size of the pores and the depth of the oxide layer. FIG. 5 shows the interconnected structure of the superficial oxides formed on a low alloy steel.

Once the component has been cooled after the treatment, it may be immersed into a quench oil containing a rust inhibitor. The components, after this treatment have an appealing, deep black colour.

Figure 6:
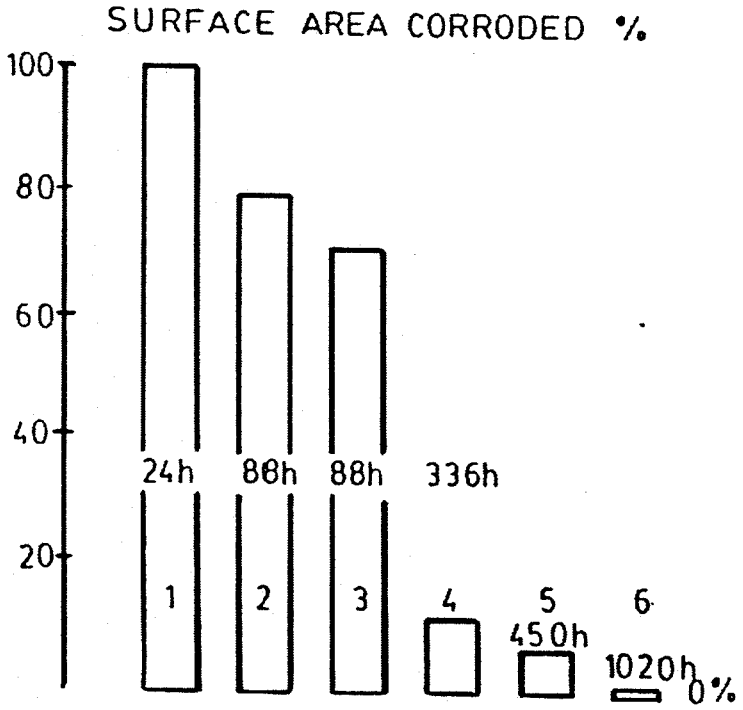
FIG. 6 represents a corrosion resistance evaluation of 1045 and low alloy steels treated according to different processes including the one according to the invention.

Components treated with the process according to the invention may be soaked in a corrosion-preventive compound. They retain their tribological properties imparted by the nitriding process; however their corrosion resistance is drastically improved. Recent corrosion resistance tests results on low alloy steel indicate a tremendous improvement over the results obtained with other methods as shown in FIG. 6. Further testing reveals that the corrosion progress on the ONC treated specimen occurs at the very slow rate. After 2,180 hours of testing only 6% of the specimen surface was covered with the corrosion products.

Figure 7:
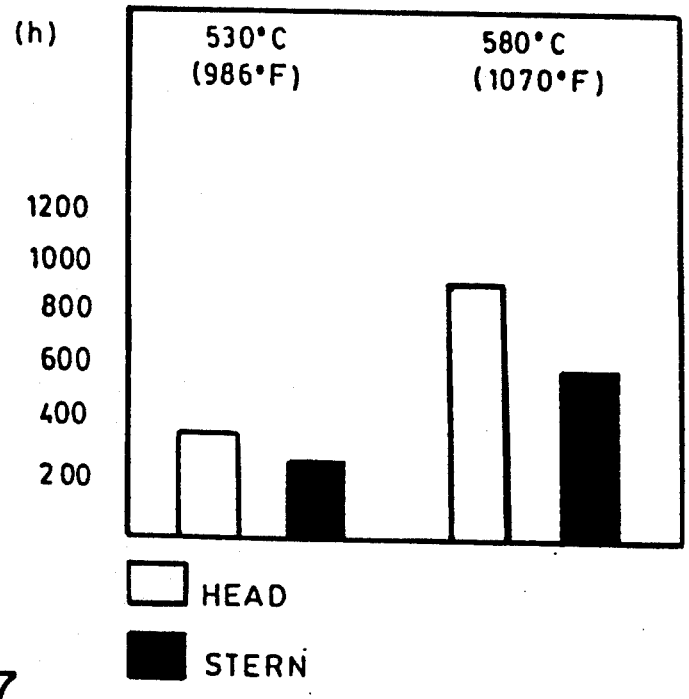
FIG. 7 represents a corrosion resistance evaluation of low carbon steel fasteners tested in marine environment.
Figure 8:
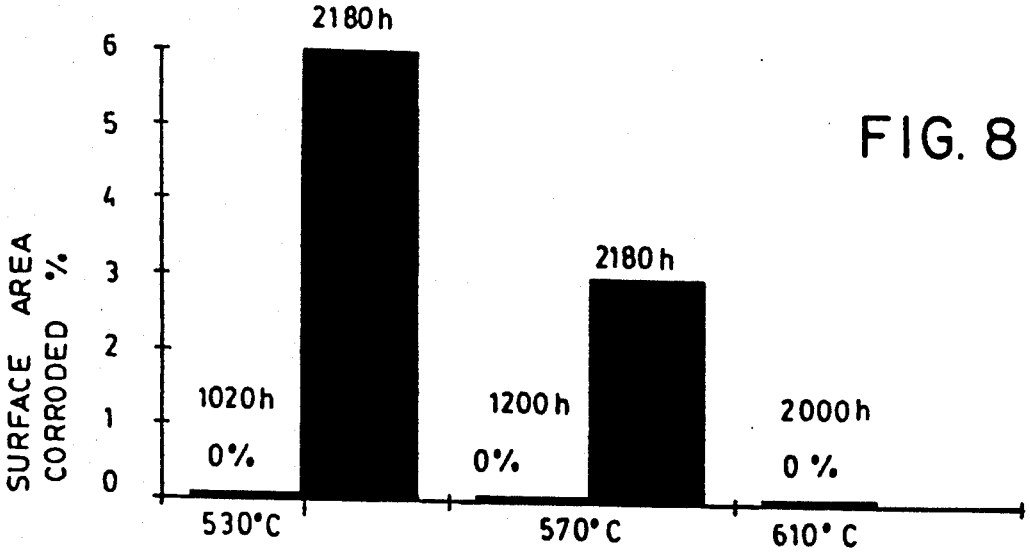
FIG. 8 represents a corrosion resistance evaluation of 1045 steel treated according to the first embodiment of the invention, but at different temperatures.

A similar tendency show low carbon steel fasteners treated at different temperature for maximum corrosion protection. Corrosion tests were carried out on a seagoing ship during a 3-month period. The tests were regarded to be more demanding than the standard ASTM salt spray test. The test results are shown in the next column as shown in FIG. 7.

EXAMPLE I

In a typical application a snowmobile chain holder made of 4130 steel with initial hardness of 180 HV5 was subjected to ONC treatment in a following manner:

The components were placed in furnace $\phi 650 \times 1500$ (mm) sealed and purged with an ammonia gas until all air has been displaced, and subsequently nitrided at 530° C. for a period of 4 hrs. Typical gas ammonia consumption was 300 l/hr. After completion of the nitriding cycle the temperature was raised to 540° C. and the ONC solution was injected. The ONC solution was a 10% (w/v) water solution of sodium cyclamate. After 45 min. of continuous injection the ONC solution was replaced with a distilled water, and the furnace was cooled down to 350° C. At that temperature the furnace was purged with nitrogen to displace water vapour. Parts were taken out of the vessel at 200° C. After the parts were removed from the vessel they were dipped in a quenching oil with added rust preventive. The parts acquired a nice satin black finish and had superficial hardness of 660 HV5. Salt spray corrosion test according to ASTMB 117 revealed that after 1000 hours of testing no traces of corrosion were visible on the components surface.

The superficial layer produced by the treatment consisted of transformed epsilon nitride approximately 4 μm in thickness and unchanged gamma prime nitride approximately 8 μm in thickness. The transformed epsilon nitride was clearly visible on a micrograph, as 4 μm thick dark grey band followed by white gamma prime iron nitride.

EXAMPLE 2

In another application, hydraulic cylinders made of 1045 steel were nitrided in a similar manner at 570° C. and subjected to a treatment according to the invention at 570°0 C. for 1 hour. The resulting superficial layer consisted of transformed grey epsilon phase, approximately 6 μm in thickness followed by an unchanged gamma prime nitride approximately 10 μm in thickness. The cylinders dipped in quenching oil containing rust preventive showed no traces of corrosion in the salt spray test after 1200 hours of testing.

We claim:

1. A process for manufacturing a corrosion resistant, iron-alloy-, iron powder metal- or iron alloy powder metal component in a closed furnace, said process comprising the steps of:

a) subjecting said component to an initial thermo-chemical nitriding treatment in said furnace in order to form onto the surface of said component a nitrogen diffusion zone followed by a superficial composite layer consisting of $\gamma$, $\epsilon$ nitride layers;

b) subsequently introducing into said furnace an aqueous solution hereinafter called ONC solution, comprising oxygen, carbon, nitrogen and sulfur, said solutions being converted into vapor within the furnace, and subjecting said component to said vapour for a length of time sufficient to allow transformation of most of said $\epsilon$ nitride layer into a porous layer of ferrous oxide(s) having a thickness of about 2 to 10 μm;

c) removing from said furnace any excess of vapor formed from said ONC solution; and d) allowing said component to cool down inside said furnace.

2. A process according to claim 1, wherein the ONC solution used in step (b) comprises:

0.7 to 7.7% N,
4.2 to 46.2% C,
1.6 to 17.6% S,
2.2 to 24.2% O.

3. A process according to claim 2, wherein the ONC solution is made from one or more, organic or inorganic water soluble compounds capable to providing either individually or collectively the requested percentage of nitrogen, carbon, oxygen and sulfur.

4. A process according to claim 3, wherein said one or more soluble compounds to be dissolved into water to form the ONC solution are selected from the group consisting of:

saccharin,
alkali salts of saccharin,
cyclamic acid, sodium cyclamate, sodium-3-methylcyclohexylsulfamate, sodium-3-methylcyclopentylsulfamate,
4-nitrosaccharin, 6-aminosaccharin, o-benzenesulfimide, 5-methylsaccharin, 6-nitrosaccharin, and thieno [3,4d]-saccharin.

5. A process according to claim 4, wherein step (b) is performed at a temperature ranging 520° C. to 540° C. for about 5 min. to 4 hrs.

6. A process according to claim 4, wherein said initial thermo-chemical nitriding treatment comprises a preliminary water-vapour oxidation step.

7. A process according to claim 4, wherein the ONC solution used in step (b) has a pH lower than or equal to 4.

8. A process according to claim 4, wherein step (c) is carried out using water vapor, acidic water vapor, $NH_3$-saturated atmosphere or an inert gas.

9. A process according to claim 4, wherein step (c) is carried out by injecting in said furnace, water having a pH lower than or equal to 4.

10. A process according to claim 4, wherein the cooled components obtained in step (d) are subsequently immersed into a quench oil containing a rust inhibitor.

11. A process for transforming an $\epsilon$ iron nitride surface layer on an iron-alloy-, iron metal-, or iron alloy powder metal component in a closed furnace, said process comprising the steps of:

(a) injecting in said furnace an acidic aqueous solution hereinafter called ONC solution, containing from 0.7 to 7.7 nitrogen, 4.2 to 46.2% carbon, 1.6 to 17.6% sulfur, and 2.2 to 24.2% oxygen, said solution being converted into vapor in said furnace, and subjecting said component to said vapour at a temperature ranging from about 520° to 540° C. for a period of time ranging from about 5 min. to 4 hrs;

(b) removing from said furnace any excess of vapor formed from said ONC solution;

(c) subsequently or simultaneously with step (b), injecting in said furnace, water having a pH equal or lower than 4; and (d) allowing said component to cool down inside said furnace.

* * * * *